US012709308B2

(12) United States Patent
Akif et al.

(10) Patent No.: US 12,709,308 B2
(45) Date of Patent: Aug. 18, 2026

(54) FUEL CONSUMPTION SYSTEM FOR LOCOMOTIVE

(71) Applicant: Progress Rail Locomotive Inc., LaGrange, IL (US)

(72) Inventors: Sammy Akif, Northlake, TX (US); Marcos Blanco Fernandes, Trophy Club, TX (US); Suhani Chacha, Fort Worth, TX (US); Thomas Reynolds, Fort Worth, TX (US)

(73) Assignee: Caterpillar Inc., Peoria, IL (US)

( * ) Notice: Subject to any disclaimer, the term of this patent is extended or adjusted under 35 U.S.C. 154(b) by 16 days.

(21) Appl. No.: 18/417,293

(22) Filed: Jan. 19, 2024

(65) Prior Publication Data

US 2025/0236322 A1 Jul. 24, 2025

(51) Int. Cl.

| | |
|---|---|
| ***B61C 5/00*** | (2006.01) |
| ***B61L 15/00*** | (2006.01) |
| ***B61L 25/02*** | (2006.01) |

(52) U.S. Cl.

CPC ..... *B61C 5/00* (2013.01); *B61L 15/0058* (2024.01); *B61L 15/0081* (2013.01); *B61L 25/025* (2013.01); *B61L 2205/04* (2013.01)

(58) Field of Classification Search

None

See application file for complete search history.

(56) References Cited

U.S. PATENT DOCUMENTS

| | | | | |
|---|---|---|---|---|
| 6,125,311 | A | 9/2000 | Lo | |
| 6,622,068 | B2 | 9/2003 | Hawthorne | |
| 6,853,889 | B2 * | 2/2005 | Cole | B60W 50/0097 701/19 |
| 7,302,895 | B2 | 12/2007 | Kumar et al. | |
| 9,376,971 | B2 * | 6/2016 | Luther | F02D 29/02 |
| 9,733,625 | B2 * | 8/2017 | Kumar | B61L 15/0058 |
| 9,815,470 | B2 * | 11/2017 | Luther | G01C 21/3415 |
| 10,077,033 | B2 | 9/2018 | Oswald et al. | |
| 10,852,150 | B2 * | 12/2020 | Li | G06N 20/00 |
| 11,332,173 | B2 * | 5/2022 | Howard | H04W 4/50 |

(Continued)

FOREIGN PATENT DOCUMENTS

| | | | |
|---|---|---|---|
| AU | 2013202194 | A1 * | 5/2013 |
| AU | 2013206474 | A1 * | 7/2013 |

(Continued)

*Primary Examiner* — Kevin R Steckbauer

(57) ABSTRACT

A method for predicting changes in fuel consumption due to alterations in train operations is disclosed. The method comprises: collecting a baseline train data of a first train, the baseline train data including first train parameters, first operational parameters, and a first fuel consumption of the first train; inputting the baseline train data into an artificial intelligence (AI) model; training an AI model with a second train data, the second train data includes second operational parameters and a second fuel consumption of the first train, the AI model is trained until a baseline operation is predictable; implementing operational changes from the baseline operation to a field train operation for a third train, the field train operation includes changes to the first train parameters and changes to the first operational parameters implemented in the third train; and predicting, utilizing the AI model, the fuel consumption of the third train.

20 Claims, 4 Drawing Sheets

(56) References Cited

U.S. PATENT DOCUMENTS

| | | | | |
|---|---|---|---|---|
| 11,447,164 | B2 * | 9/2022 | Howard | B61L 27/20 |
| 11,453,421 | B2 * | 9/2022 | Howard | B61L 27/60 |
| 11,472,452 | B2 * | 10/2022 | Howard | B61L 25/025 |
| 11,787,453 | B2 * | 10/2023 | Howard | B61L 27/53 701/19 |
| 11,858,543 | B2 * | 1/2024 | Akif | G06N 3/09 |
| 11,919,552 | B2 * | 3/2024 | Akif | B61L 27/40 |
| 11,964,678 | B2 * | 4/2024 | Schoenly | B61C 17/12 |
| 12,172,684 | B2 * | 12/2024 | Akif | B60L 58/12 |
| 12,179,817 | B2 * | 12/2024 | Wait | B61L 27/04 |
| 12,195,067 | B2 * | 1/2025 | Wait | B61L 27/16 |
| 12,208,828 | B2 * | 1/2025 | Brand | B61L 27/57 |
| 12,269,521 | B2 * | 4/2025 | Akif | B61C 3/02 |
| 12,286,146 | B2 * | 4/2025 | Brand | B60L 15/32 |
| 2004/0064235 | A1 * | 4/2004 | Cole | B60T 8/172 701/70 |
| 2015/0232097 | A1 * | 8/2015 | Luther | G01C 21/3415 701/1 |
| 2016/0368495 | A1 * | 12/2016 | Luther | B61L 15/0058 |
| 2019/0145789 | A1 * | 5/2019 | Li | G01C 21/3469 701/123 |
| 2021/0070334 | A1 * | 3/2021 | Howard | B61L 27/40 |
| 2021/0070336 | A1 * | 3/2021 | Howard | G05B 13/0265 |
| 2021/0107535 | A1 * | 4/2021 | Howard | H04W 4/021 |
| 2021/0107538 | A1 * | 4/2021 | Howard | B61L 27/20 |
| 2021/0107539 | A1 * | 4/2021 | Howard | G06F 18/241 |
| 2021/0107543 | A1 * | 4/2021 | Howard | G06N 3/08 |
| 2021/0107545 | A1 * | 4/2021 | Howard | B61L 25/025 |
| 2021/0122402 | A1 | 4/2021 | Böhm et al. | |
| 2021/0285787 | A1 * | 9/2021 | Alekseenko | G01C 21/3682 |
| 2022/0024497 | A1 * | 1/2022 | Schoenly | B61L 15/0072 |
| 2022/0194440 | A1 * | 6/2022 | Akif | B61L 15/0072 |
| 2022/0194446 | A1 * | 6/2022 | Akif | B61L 27/40 |
| 2023/0154250 | A1 * | 5/2023 | Jiang | B60W 40/107 701/1 |
| 2023/0159069 | A1 * | 5/2023 | Brand | B61L 15/0081 701/19 |
| 2023/0391384 | A1 * | 12/2023 | Hullemeyer | B61L 15/0018 |
| 2024/0083478 | A1 * | 3/2024 | Liu | B61L 25/026 |
| 2024/0166249 | A1 * | 5/2024 | Akif | B60L 15/2045 |
| 2024/0174276 | A1 * | 5/2024 | Akif | B61C 7/04 |
| 2024/0199096 | A1 * | 6/2024 | Brand | B61L 15/0058 |
| 2024/0199099 | A1 * | 6/2024 | Wait | B61L 27/60 |
| 2024/0199100 | A1 * | 6/2024 | Brand | B61L 15/0072 |
| 2024/0199101 | A1 * | 6/2024 | Wait | B61C 17/12 |
| 2024/0420016 | A1 * | 12/2024 | Fernandes | G06N 20/00 |
| 2025/0115168 | A1 * | 4/2025 | Telford | B60L 15/20 |
| 2025/0236322 | A1 * | 7/2025 | Akif | B61L 15/0081 |

FOREIGN PATENT DOCUMENTS

| | | | | |
|---|---|---|---|---|
| AU | 2013206546 | A1 * | 1/2014 | G06Q 10/04 |
| AU | 2015200168 | A1 * | 2/2015 | |
| AU | 2016202936 | A1 * | 5/2016 | |
| AU | 2017202481 | A1 * | 5/2017 | |
| AU | 2013206546 | B2 * | 12/2018 | G06Q 10/04 |
| AU | 2020340919 | A1 * | 3/2022 | B61L 27/04 |
| AU | 2020341345 | A1 * | 3/2022 | G05B 13/0265 |
| AU | 2020362100 | A1 * | 4/2022 | G06N 3/08 |
| AU | 2020363905 | A1 * | 4/2022 | B61L 27/04 |
| AU | 2020364371 | A1 * | 4/2022 | G06N 3/0499 |
| AU | 2020340919 | B2 * | 7/2022 | B61L 27/04 |
| AU | 2020362100 | B2 * | 9/2022 | G06N 3/08 |
| AU | 2020363905 | B2 * | 9/2022 | B61L 27/20 |
| AU | 2020364371 | B2 * | 9/2022 | G06N 3/0499 |
| AU | 2023258439 | A1 * | 6/2024 | B61L 27/04 |
| AU | 2023395626 | A1 * | 6/2025 | B61L 27/04 |
| CA | 2622726 | A1 * | 11/2007 | B61L 27/16 |
| CA | 2432494 | C * | 7/2009 | G05B 13/027 |
| CA | 2884113 | C * | 8/2017 | B61C 15/14 |
| CA | 3101582 | A1 * | 2/2020 | B61L 27/20 |
| CA | 3219358 | A1 * | 11/2022 | G06V 20/52 |
| CA | 3101582 | C * | 10/2023 | B61L 25/025 |
| CN | 101356089 | A * | 1/2009 | |
| CN | 102112358 | A * | 6/2011 | B61L 27/16 |
| CN | 102741105 | A * | 10/2012 | B61L 27/14 |
| CN | 102741105 | B * | 2/2016 | B61L 27/14 |
| EP | 3483801 | A1 * | 5/2019 | G01C 21/3469 |
| EP | 3854624 | A1 * | 7/2021 | G06N 3/092 |
| EP | 3940599 | A1 * | 1/2022 | G06N 5/022 |
| EP | 3854624 | B1 * | 9/2024 | G06N 3/092 |
| FR | 3106679 | A1 * | 7/2021 | G06N 3/092 |
| KR | 20240000075 | A * | 1/2024 | B61L 27/60 |
| WO | WO-0108959 | A1 * | 2/2001 | B61L 15/0081 |
| WO | WO-2021045983 | A1 * | 3/2021 | G05B 13/0265 |
| WO | WO-2021045988 | A1 * | 3/2021 | B61L 27/04 |
| WO | WO-2021071776 | A1 * | 4/2021 | G06N 3/0499 |
| WO | WO-2021071778 | A1 * | 4/2021 | G06N 3/08 |
| WO | WO-2021072143 | A1 * | 4/2021 | B61L 27/04 |
| WO | WO-2023208744 | A1 * | 11/2023 | G06N 3/088 |
| WO | WO-2024022141 | A1 * | 2/2024 | B60W 50/0097 |
| WO | WO-2024129304 | A1 * | 6/2024 | B61L 27/04 |

* cited by examiner

FUEL CONSUMPTION SYSTEM FOR LOCOMOTIVE

TECHNICAL FIELD

The present disclosure relates to power supplies for trains, and more specifically relates to a hybrid propulsion system and a method of boosting power supplied to a train.

BACKGROUND

A train consist is the arrangement and organization of multiple trains that work together, typically within a train. These trains may be connected in a specific order to provide the necessary power and traction to move the train efficiently, especially when handling heavy loads or traveling through challenging terrain.

A train consist typically includes a lead train, which is at the front of the train, and one or more trailing trains positioned behind it. The lead train is responsible for controlling the train's movement, receiving signals from the train crew, and providing power to the train's systems. Trailing trains in the consist provide additional traction and power, especially on steep gradients or in situations where the train is very long or heavy. The arrangement and number of trains in a consist is typically assigned based on factors such as the train's weight, length, the type of terrain it will traverse, and the resulting power requirements.

The railroad industry is constantly evolving, with new operational changes, products, and strategies being introduced to enhance efficiency and performance. These changes often target improvements in key performance indicators such as fuel consumption, time management, capacity, network velocity, and in-train forces, which are crucial for the smooth operation of the railroad network.

However, accurately measuring the impact of these changes poses a significant challenge due to the high variability of operational conditions within the railroad network. Variability factors include weather conditions, the health of assets, the makeup of train consists, frequency of stops, and more. Such factors not only vary independently but also interact with each other, adding complexity to any measurement and analysis, especially in predicting the fuel consumption of the train.

The current methodologies for assessing the impact of operational changes on trains are insufficient. The first approach is only effective when changes can be isolated and the test environment mirrors real-world conditions. However, the complexity and variability of railroad operations often render this method impractical and unrepresentative of actual field conditions. Another inefficient method involves collecting baseline and post-change data requiring substantial time and labor required to normalize data against the myriad of variabilities inherent in railroad operations. This cumbersome process is exacerbated when accounting for the intricate interplay of factors such as weather, asset condition, train composition, and operational procedures.

Others have attempted to predict the fuel consumption of trains after implementing operation changes, but have failed to provide an accurate and practical method to predict fuel consumption. For example, U.S. Pat. No. 10,223,935 proposes a system that calculates a driver efficiency score. This score is based on defining at least one metric, such as deviations from an optimal RPM range, use of cruise control at highway speeds, and adherence to a predetermined maximum speed. Data related to these metrics are collected during the driver's operation of a vehicle, and the efficiency score is adjusted based on the frequency of deviations. However, this system falls short in accurately predicting fuel consumption for changes in train operations and modifications to the train itself.

Hence, there exists a need for a fuel consumption system that provides enhanced accuracy, efficiency, automation, and prediction of fuel consumption to trains when changes are made to a train operation.

SUMMARY

In accordance with one aspect of the disclosure, a method for predicting changes in fuel consumption due to alterations in train operations is disclosed. The method comprises: collecting a baseline train data of a first train, the baseline train data including first train parameters, first operational parameters, and a first fuel consumption of the first train; inputting the baseline train data into an artificial intelligence (AI) model; training an AI model with a second train data, the second train data includes second operational parameters and a second fuel consumption of the first train, the AI model is trained until a baseline operation is predictable; implementing operational changes from the baseline operation to a field train operation for a third train, the field train operation includes changes to the first train parameters and changes to the first operational parameters implemented in the third train; and predicting, utilizing the AI model, the fuel consumption of the third train.

In accordance with another aspect of the disclosure, a train is disclosed. The train comprises: a frame; ground engaging elements supporting the frame; a prime mover for powering propulsion of the ground engaging elements, the prime mover mounted in the frame; a plurality of consists; and a controller including an AI model for predicting fuel consumption. The AI model is configured to: collect a baseline train data of the train, the baseline train data including first train parameters, first operational parameters, and a first fuel consumption of a historical train; train the AI model with a second train data until a baseline operation is predictable, the second train data includes second operational parameters and a second fuel consumption of the train; analyze implemented operational changes from the baseline operation to the train including changes to the first train parameters, and changes to the first operational parameters; and predict the fuel consumption of the for the field operation.

In accordance with another aspect of the disclosure, a system for predicting fuel consumption in a train. The system comprises: a controller having a data collection module configured to collect baseline train data for the train, the baseline train data including initial train parameters, initial operational parameters, and an initial fuel consumption based on historical data of the train; and an artificial intelligence (AI) model in the controller, operatively connected to the data collection module. The AI model is configured to: receive and process the baseline train data; iterative training with new train data to establish a predictive baseline operation model for the train, the new train data includes new operational parameters and corresponding fuel consumption data; an operational change module in the controller configured to track changes in train operations, including modifications to the train, adjustments to the initial train parameters, and alterations to the initial operational parameters. The controller further includes a fuel prediction unit configured to: receive data regarding operational changes from the operational change module; and predict the fuel consumption for the train reflecting the changes in train operations.

These and other aspects and features of the present disclosure will be better understood upon reading the following detailed description when read in conjunction with the accompanying drawings.

Figure 1:
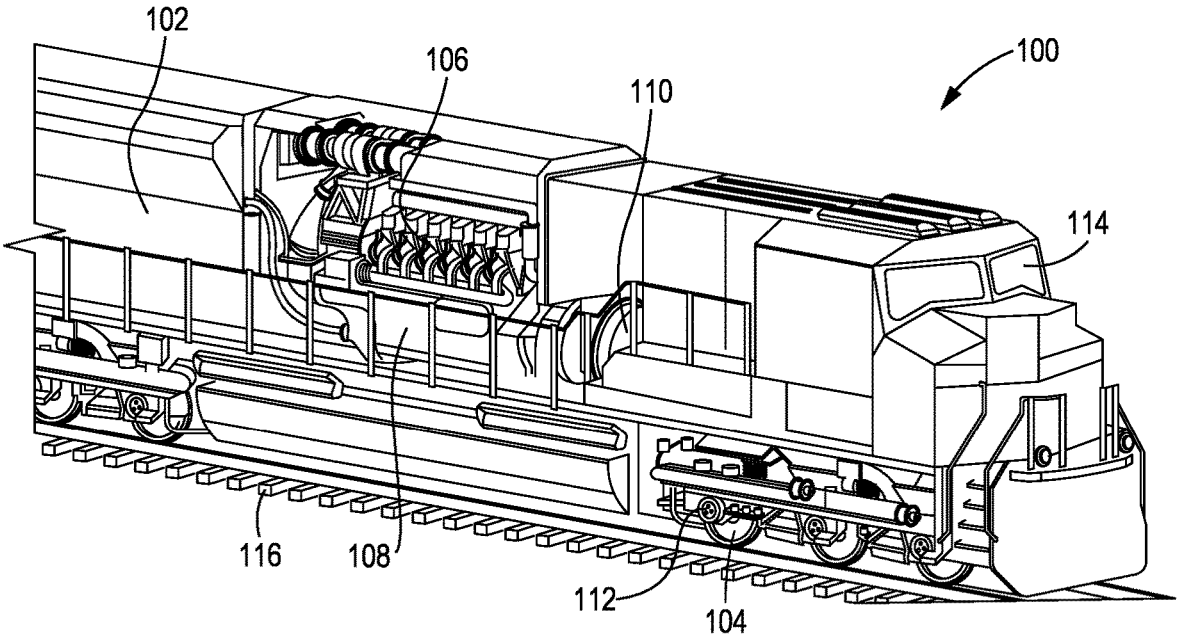
FIG. 1 is a perspective view of a train, according to an embodiment of the present disclosure.

The figures depict one embodiment of the presented disclosure for purposes of illustration only. One skilled in the art will readily recognize from the following discussion that alternative embodiments of the structures and methods illustrated herein may be employed without departing from the principles described herein.

DETAILED DESCRIPTION

Referring now to the drawings, and with specific reference to the depicted example, a train 100 is shown, illustrated as an exemplary train. Trains are vehicles designed to transport goods and materials across railways. While the following detailed description describes an exemplary aspect in connection with the train, it should be appreciated that the description applies equally to the use of the present disclosure in other trains, including, but not limited to, trains, hybrid trains, and hybrid trains, as well.

Referring now to FIG. 1, the train 100 comprises a frame 102. The frame 102 is supported on ground engaging elements 104, illustrated as continuous tracks. It should be contemplated that the ground engaging elements 104 may be any other type of ground engaging elements 104 such as, for example, wheels, train wheel systems, etc. The train 100 further includes a prime mover 106 in the frame 102, a battery 108, a transmission 110 for converting mechanical energy from the prime mover 106 to drive the ground engaging elements 104, a transmission 110 associated with the prime mover 106, a traction motor 112 for converting electrical energy into mechanical energy to drive the ground engaging elements 104, and a cab 114 for operator personnel to operate the train 100.

The prime mover 106 may be an internal combustion engine serving as the primary source of train power, as generally known in the arts. The prime mover 106 may use diesel or gasoline as fuel. The use of an internal combustion engine as the prime mover 106 may provide the train 100 with required necessary power and torque to handle various loads and terrains. The prime mover 106 converts fuel and air into mechanical energy, propelling the train 100 and facilitating its movement along railway tracks 116.

The traction motor 112 may convert electrical power, sourced from the battery 108, into mechanical power to boost the tractive power of the ground engaging elements 104 moving along the railway tracks 116. This mechanical power generated by the traction motor 112 may be utilized to drive the ground engaging elements 104 of the train 100, providing the necessary torque for movement and speed control. In diesel-electric trains, the traction motor 112 may also receive power from the prime mover 106 associated with a generator.

Figure 2:
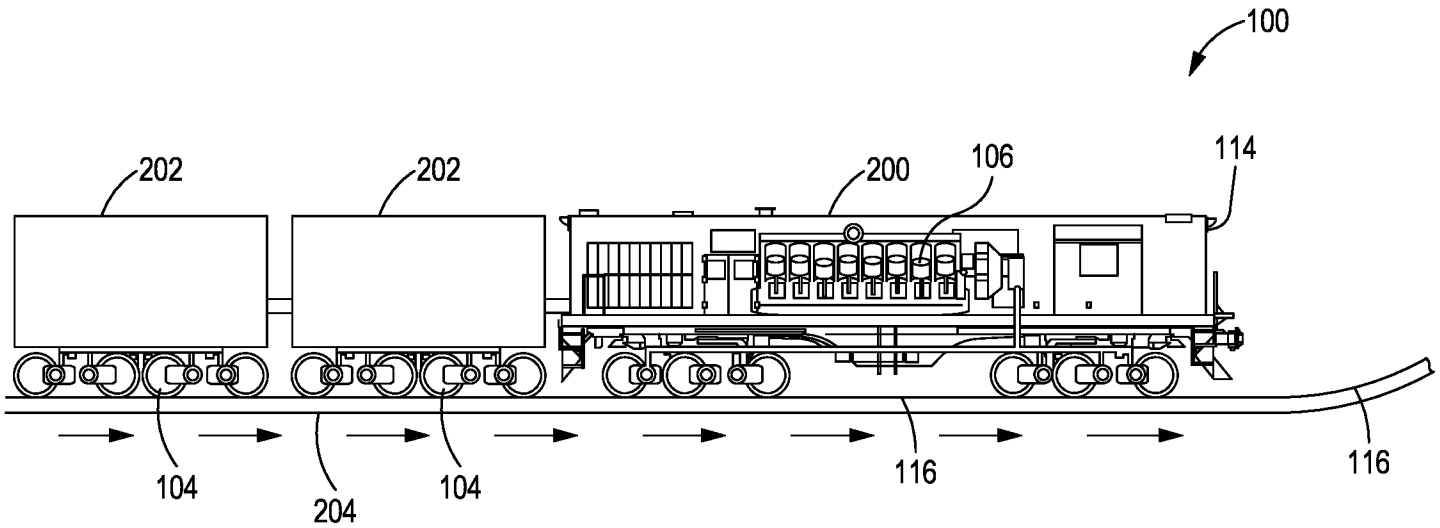
FIG. 2 is diagram of the train of FIG. 1 on a route, according to one embodiment of the disclosure.

FIG. 2 is a diagram of the train 100 traveling on the railway tracks 116, according to one embodiment of the disclosure. The train 100 may have a lead train 200 and a plurality of consists 202 traveling on a route 204. The train 100, equipped with a lead train 200 and a plurality of consists 202, traverses the route 204, which may encompass diverse terrains and environmental conditions. This journey can include varying gradients, curves, and potentially challenging weather scenarios. The route 204 may also feature multiple stops, intersections with other rail lines, and diverse speed zones, requiring precise navigation and operational control. Additionally, the route 204 might be equipped with advanced signaling and communication systems, ensuring the safe and timely passage of the train 100 while optimizing travel efficiency and minimizing delays.

Figure 3:
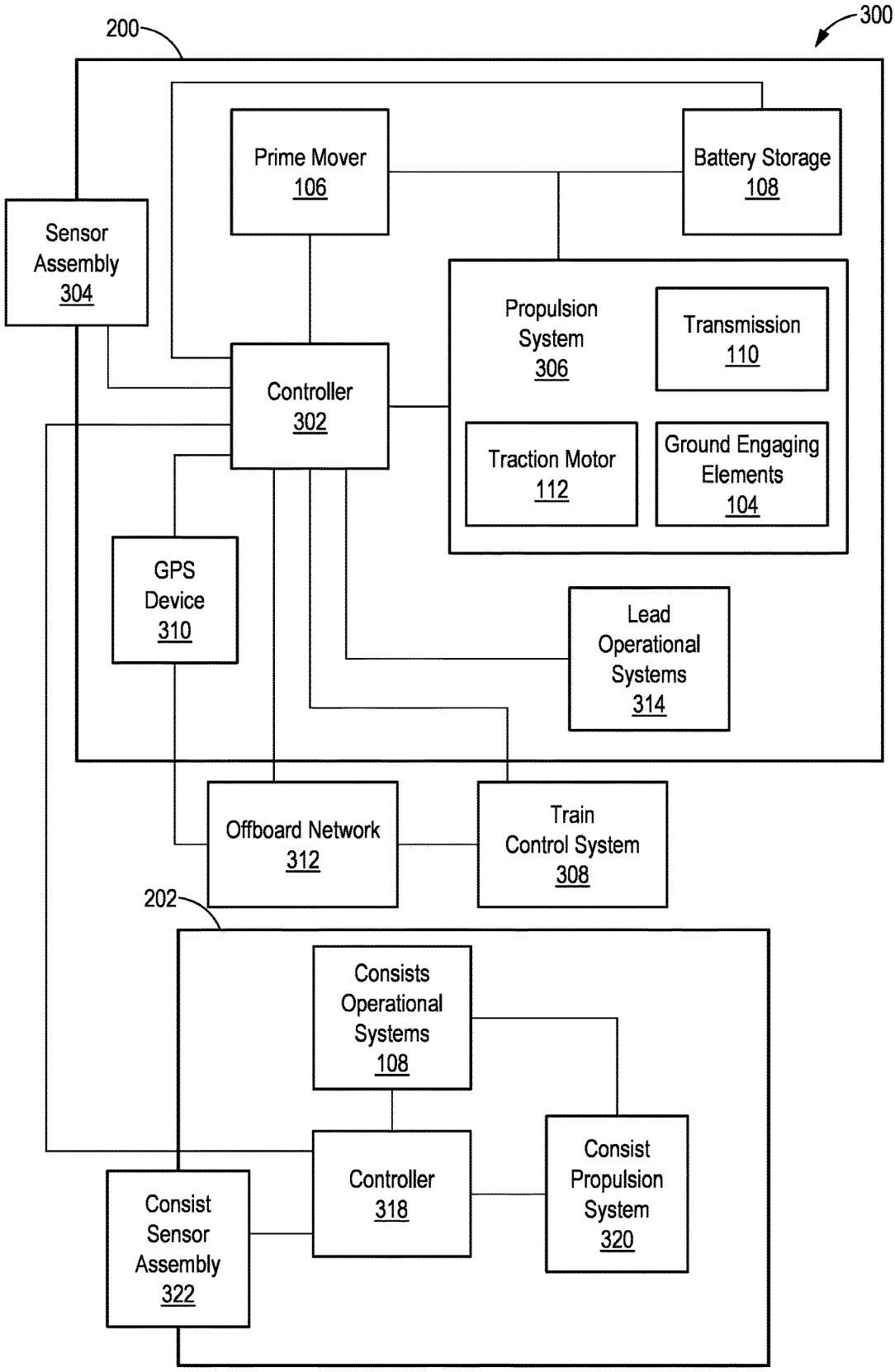
FIG. 3 is a block diagram of a fuel consumption propulsion system in the train of FIG. 1, according to an embodiment of the present disclosure.

Now referring to FIG. 3, a block diagram of a fuel consumption system 300 of the train 100 is illustrated, according to one embodiment of the disclosure. The fuel compensation system for the train 100 comprises the prime mover 106, the battery 108, a controller 302, a sensor assembly 304, and a propulsion system 306. The propulsion system 306 includes the transmission 110 and the ground engaging elements 104. The controller 302 may be further connected to a train control system 308, a GPS device 310, and an off-board network 312.

The fuel consumption system 300, via the controller 302, monitors the power supply to the train 100 based on the location of the train 100, as detected by the controller 302. The controller 302 may be a central processing unit (CPU) that controls the overall operation of the train 100. The controller 302 may include any general-purpose processor known in the art.

During operation of the train 100, the controller 302 in the train 100 may monitor, via the sensor assembly 304, lead operational systems 314, including train parameters associated with the train 100, the lead train 200, and/or the plurality of consists 202. The lead operational systems 314 may be one of many operating systems found within a train 100 such as an ignition system, a fuel injection system, an oil transport system, the transmission 110, a throttle system, a power system, a braking system, a cooling system, a navigation system, a lighting system, an alarm system, a battery system, and/or an engine or other propulsion system, as generally known in the arts. The lead operational systems 314 may also include one or more hydraulic, mechanical, electronic, and software-based components in which the controller 302 may communicate with and control, as generally known in the arts.

The train control system 308, such as North America's PTC, may provide both the characteristics and makeup of the train 100, the parameters of the lead train 200, and the plurality of consists 202, the route 204, and a topography of the route 204.

The controller 302 in the fuel consumption system 300 is configured to monitor the amount of fuel consumed by the prime mover 106 by the train 100, based on characteristics and parameters of the lead train 200 and the plurality of consists 202 on the route 204. The controller 302 determines the location of the train 100 via the train control system 308 and/or the GPS device 310.

The GPS device 310 is configured to detect the location of the train 100. The GPS device 310 determines a global position of the train 100 in the form of latitude and longitude. Based on the global position, the controller 302 detects when the amount of fuel consumption by the train 100 when the train 100 travels along the route 204.

The train 100 may be connected to a plurality of consists 202, the plurality of consists 202 each having a consist operational systems 316, a second controller 318, a second propulsion system 320, and a second sensor assembly 322. The controller 302 may be in further communication with the second controller 318. The controller 302 may coordinate communications throughout the train 100 with the second controller 318 to monitor fuel consumption of the train 100.

When the train 100 travels across the route 204, the controller 302 may monitor all the aspects of the lead train 200 and the plurality of consists 202. The controller 302 may be configured with an artificial intelligence (AI) model that employs a recurrent neural network (RNN) architecture, optimized for sequential data processing, to accurately forecast fuel consumption variations in response to the simulated changes in train operations. Furthermore, the controller 302 is adaptable to incorporate various alternative AI model architectures, enhancing its capability in forecasting and operational analysis for the train 100. These alternatives include Convolutional Neural Networks (CNNs) for spatial data hierarchy recognition, Long Short-Term Memory networks (LSTMs) and Gated Recurrent Units (GRUs) for efficient long-term data dependency handling, and Transformer Models that utilize attention mechanisms for improved sequential data processing efficiency. The Additionally, simpler Feedforward Neural Networks, efficient Autoencoders for anomaly detection in time-series data, and Hybrid Models combining multiple neural network architectures like CNN-LSTM can also be integrated. Each architecture offers unique benefits, allowing the controller 302 to be highly versatile and effective in managing various forecasting scenarios related to train operations, including fuel consumption variations. The AI model may also employ Regression Models such as Linear Regression, Logistic Regression, Polynomial Regression, Ridge Regression, Lasso Regression, Quantile Regression, Bayesian Linear Regression, Principal Components Regression, Partial Least Squares Regression, Elastic Net Regression, Step wise Regression, Support Vector Machine Regression, and Decision Tree Regression.

The controller 302 may employ AI Regularization Techniques, including Lasso Regularization, to analyze and predict operational impacts of the train 100 with various operational factors and their effects on overall efficiency for fuel consumption. By incorporating a vast array of data points, including train schedules, topography, cargo loads, weather conditions, and track maintenance records, the controller 302 can generate accurate predictions of fuel consumption and fuel economy to help optimize train operations. Beyond Lasso Regularization, the controller 302 may also implement a variety of other regularization techniques to enhance its predictive capabilities and ensure robust performance. These techniques help in managing and improving the generalization of the AI model to new data received by the controller 302. Other regularization techniques that may be utilized, as generally known in the arts include: Ridge Regularization; Elastic Net; Dropout; Batch Normalization; Early Stopping; Max Norm Constraints; Data Augmentation; Noise Injection; Weight Decay; Feature Engineering; and Label Smoothing. The controller 302 may incorporate one or more of the regularization techniques to analyze and predict operational impacts of the train 100.

The fuel consumption system 300 allows for a dynamic response to changing operational conditions. For instance, in the event of an unexpected track obstruction, the system can quickly analyze alternative routes and schedules, minimizing delays and maintaining operational efficiency. The controller 302 may utilize data analytics, regularization techniques, and AI model architectures to improve fuel efficiency and predict fuel consumption. By analyzing historical data on fuel consumption under various conditions, the system can predict fuel consumption when changes to train 100 are implements such as a new lead train, a new train consist, or any changes to recommend operational adjustments that reduce fuel usage without compromising on schedule adherence. This not only leads to cost savings but also contributes to environmental sustainability.

Through continuous monitoring and analysis, the controller 302 adapts to changing parameters and predicts fuel consumption outcomes to ensure that train operations can be optimized for efficiency, considering a wide range of variables that may influence fuel consumption for trains.

INDUSTRIAL APPLICABILITY

In operation, the present disclosure may find applicability in many industries including, but not limited to, the railroad industry. Specifically, the systems, machines, and methods of the present disclosure may be used for propulsion systems of other trains and work machines including, but not limited to, trains, trucks, and marine vessels, locomotives, and similar trains utilizing combustion engines. While the foregoing detailed description is made with specific reference to trains, it is to be understood that its teachings may also be applied to other trains. The fuel consumption system 300 may be provided as a retrofit onto these other applications.

Figure 4:
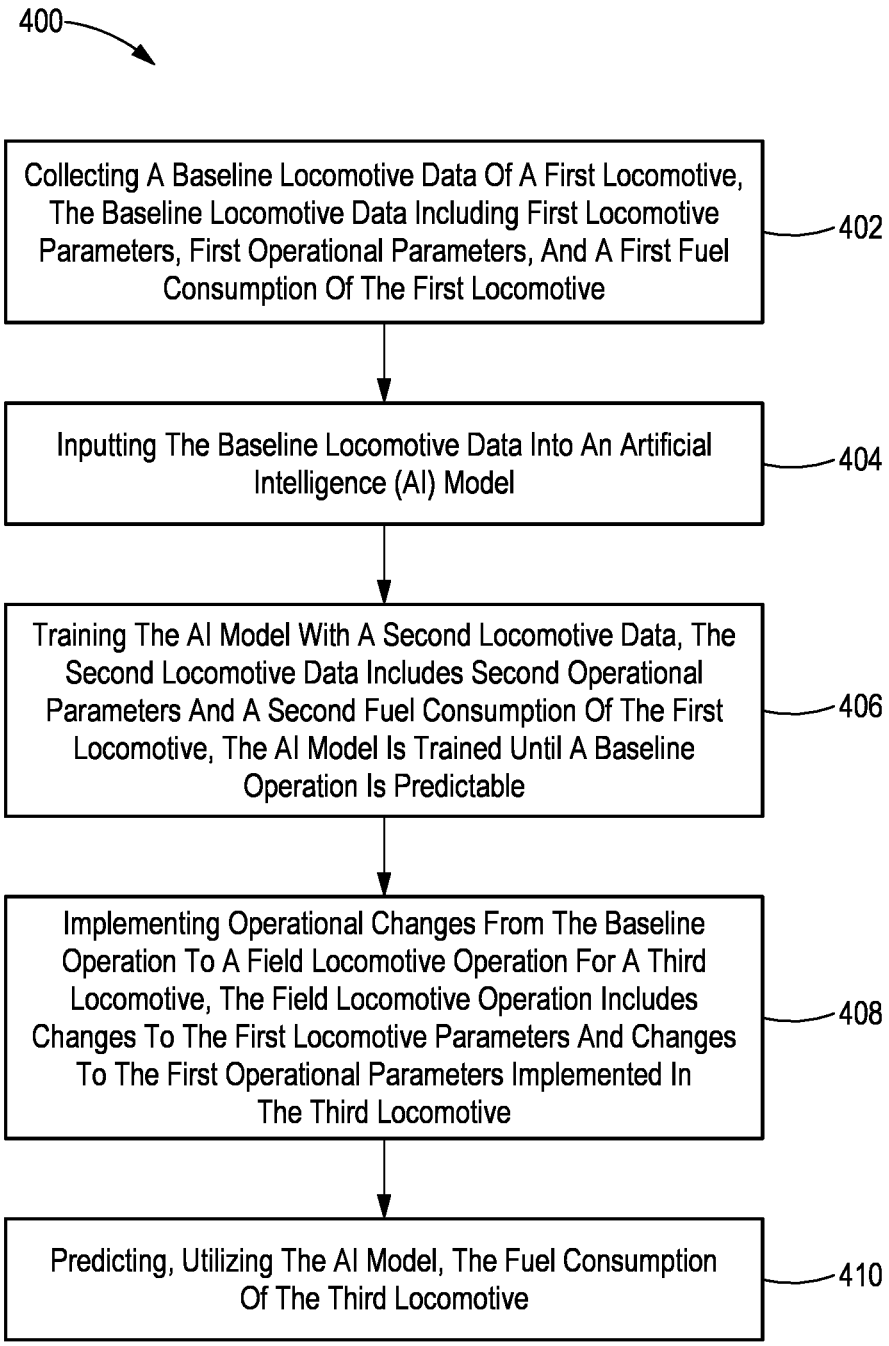
FIG. 4 is a flow-chart of a method of predicting fuel consumption for the train of FIG. 2 according to an embodiment of the present disclosure.

Now referring to FIG. 4, a method 400 for predicting fuel consumption is illustrated. In a step 402, the controller 302 begins by establishing a comprehensive baseline of fuel consumption under standard operational conditions. This baseline is created by aggregating historical data related to fuel usage, operational parameters of the train 100, the route 204, and environmental conditions. In step 402, the controller 302 may collect a baseline train data of a first train, the baseline train data including first train parameters, first operational parameters, and a first fuel consumption of the first train.

In a step 404, the controller 302 inputting the baseline train data into an artificial intelligence (AI) model. The controller 302 employs an AI model to continuously monitor and analyze ongoing fuel consumption by the train 100, the lead train 200, and the plurality of consists 202, where the controller 302 communicates with the sensor assembly 304 and second sensor assembly 322.

In a step 406, the controller 302 is trained to identify and adapt to the nuances of fuel usage patterns in relation to various train operational parameters and route parameters. The training process involves iterative refinement of the model to ensure precise understanding and prediction of fuel consumption under varying operational conditions. The AI model may be trained with a second train data, the second train data includes second operational parameters and a second fuel consumption of the first train. The AI model is trained until a baseline operation is predictable in step 406.

In a step 408, operational changes from the baseline operation to a field train operation are implemented in the train 100. The operational changes to the field train operation includes changes to the first train parameters and changes to the first operational parameters. These may be implemented in the train 100 in which the controller 302 may predict fuel consumption for a third train operation. These changes can include modifications in train parameters, such as engine efficiency or consist weight, route alterations, like changes in track elevation or curvature, and variations in weather conditions.

In a step 410, the controller 302 is then utilized to predict the fuel consumption in the third train with the field operation changes implemented. The AI model in the controller 302 iteratively assesses the impact of these changes on fuel consumption, comparing it against the established baseline. For each new change, the controller 302 updates its predictive model to reflect the latest operational conditions. This ongoing adaptation ensures that the system remains accurate in predicting fuel consumption for any new set of parameters. The controller 302 is able to predict fuel consumption with each new change allows for an ongoing optimization process, where train operations can be continually adjusted for maximum fuel efficiency.

From the foregoing, it can be seen that the technology disclosed herein has industrial applicability in the fields of trains for improving fuel economy by predicting fuel consumption for train operations for changes implemented in the train and its operations.

What is claimed is:

1. A method for predicting changes in fuel consumption due to alterations in train operations, the method comprising:

collecting a baseline train data of a train, the baseline train data including first train parameters, first operational parameters, and a first fuel consumption of a historical train;

inputting the baseline train data into an artificial intelligence (AI) model;

training the AI model with a second train data, the second train data including second operational parameters and a second fuel consumption of the train, wherein the AI model is trained until a baseline operation is predictable;

implementing operational changes from the baseline operation to a field train operation of the train, wherein the field train operation includes changes to the first train parameters and changes to the first operational parameters; and predicting, utilizing the AI model, the fuel consumption of the field train operation.

2. The method of claim 1, wherein:

the baseline train data includes baseline train run data and simulation data;

the first train parameters include train tonnage, consist tonnage, a propulsion systems, a train system change, and consist changes from the baseline operation; and the first operational parameters includes a route dataset, total trip time, consist tonnage, horsepower, train performance, tractive effort, braking efficiency, track information, and historical fuel consumption metrics.

3. The method of claim 1, further comprising:

applying a simulation of proposed operational changes to the AI model, wherein the proposed changes include at least one of the following: speed alteration, load variation, route modification, or operational strategy adjustment.

4. The method of claim 1, wherein the AI model utilizes a Regularization Technique.

5. The method of claim 1, further comprising:

comparing a predicted fuel consumption with the baseline train data to quantify an impact of proposed operational changes on the fuel consumption.

6. The method of claim 1, wherein the AI model employs one chosen from the group consisting of Convolutional Neural Networks (CNNs), Long Short-Term Memory networks (LSTMs), Gated Recurrent Units (GRUs), Transformer Models, Feedforward Neural Networks, Autoencoders, Hybrid Models, Regression Models, Linear Regression, Logistic Regression, Polynomial Regression, Ridge Regression, Lasso Regression, Quantile Regression, Bayesian Linear Regression, Principal Components Regression, Partial Least Squares Regression, Elastic Net Regression, Step wise Regression, Support Vector Machine Regression, and Decision Tree Regression.

7. The method of claim 2, wherein the route dataset includes characteristics of the train, a route of the train, and a topography of the route.

8. A train comprising:

a frame;

ground engaging elements supporting the frame;

a prime mover for powering propulsion of the ground engaging elements, the prime mover mounted in the frame;

a plurality of consists; and a controller including an artificial intelligence (AI) model for predicting fuel consumption of a field operation, the AI model configured to:

collect a baseline train data of the train, the baseline train data including first train parameters, first operational parameters, and a first fuel consumption of a historical train, train the AI model with a second train data until a baseline operation is predictable, the second train data includes second operational parameters and a second fuel consumption of the train, analyze implemented operational changes from the baseline operation to the train including changes to the first train parameters, and changes to the first operational parameters, and predict the fuel consumption of the field operation.

9. The train of claim 8, wherein the train is connected to the plurality of consists, each consist having second ground engaging elements and a second controller.

10. The train of claim 9, further comprising:

a GPS device in communication with the controller, the GPS device providing real-time location of the train, wherein the controller is further configured to consider topography of a route and weather conditions along the route in predicting the fuel consumption.

11. The train of claim 9, wherein:

the baseline train data includes baseline train run data, simulation data, train tonnage, consist tonnage, a propulsion system performance data, a train system change, and consist changes from the baseline operation, and the first operational parameters include a total trip time, consist tonnage, horsepower, train performance, tractive effort, braking efficiency, track information, and historical fuel consumption metrics.

12. The train of claim 9, wherein the AI model is further configured to apply a simulation of proposed operational changes to the AI model, wherein the proposed changes include at least one chosen from the group consisting of: a speed alteration, a load variation, a route modification, and a train system change.

13. The train of claim 9, wherein the AI model utilizes a Regularization Technique.

14. A system for predicting fuel consumption in a train, the system comprising:

a controller including a processor, the controller comprising:

a data collection module configured to collect baseline train data for the train, the baseline train data including initial train parameters, initial operational parameters, and an initial fuel consumption based on historical data of the train, an artificial intelligence (AI) model operatively connected to the data collection module, configured to: receive and process the baseline train data, and iteratively train with new train data of the train to establish a predictive baseline operation model for the train, the new train data including new operational parameters and corresponding fuel consumption data of the train, an operational change module configured to track changes in train operations, including modifications to the train, adjustments to the initial train parameters, and alterations to the initial operational parameters, and a fuel prediction unit configured to:

receive data regarding operational changes from the operational change module, and predict the fuel consumption for the train reflecting the changes in train operations.

15. The system of claim 14, wherein:

the baseline train data includes baseline train run data, simulation data, train tonnage, consist tonnage, propulsion system performance data, a train system change, and consist changes from the baseline operation, and the initial operational parameters include a total trip time, consist tonnage, horsepower, train performance, tractive effort, braking efficiency, track information, and historical fuel consumption metrics, wherein the fuel prediction unit is further configured to calculate fuel consumption savings from the changes in train operations.

16. The system of claim 15, wherein the AI model is further configured to apply a simulation of proposed operational changes to the AI model, wherein the proposed changes include at least one chosen from the group consisting of: a speed alteration, a load variation, a route modification, and a train system change.

17. The system of claim 15, wherein the AI model utilizes a Regularization Technique.

18. The system of claim 15, wherein the AI model is further configured to compare a predicted fuel consumption with the baseline train data to quantify an impact of the operational changes on the fuel consumption of the train.

19. The system of claim 15, wherein the AI model employs one chosen from the group consisting of Convolutional Neural Networks (CNNs), Long Short-Term Memory networks (LSTMs), Gated Recurrent Units (GRUs), Transformer Models, Feedforward Neural Networks, Autoencoders, Hybrid Models, Regression Models, Linear Regression, Logistic Regression, Polynomial Regression, Ridge Regression, Lasso Regression, Quantile Regression, Bayesian Linear Regression, Principal Components Regression, Partial Least Squares Regression, Elastic Net Regression, Step wise Regression, Support Vector Machine Regression, and Decision Tree Regression.

20. The system of claim 15, wherein the initial operational parameters further include a route dataset, the route dataset including characteristics of the train, a route of the train, and a topography of the route.

* * * * *